US011575225B2

(12) United States Patent
Liu et al.

(10) Patent No.: US 11,575,225 B2
(45) Date of Patent: Feb. 7, 2023

(54) ELECTRICAL CONNECTOR

(71) Applicant: Tyco Electronics (Shanghai) Co. Ltd., Shanghai (CN)

(72) Inventors: Jiaoyong (Mac) Liu, Shanghai (CN); Jie (Roger) Luo, Foshan (CN); Guangming (Suny) Zhao, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 17/510,739

(22) Filed: Oct. 26, 2021

(65) Prior Publication Data

US 2022/0131300 A1 Apr. 28, 2022

(30) Foreign Application Priority Data

Oct. 26, 2020 (CN) ..... 202011156609.X

(51) Int. Cl.
*H01R 13/24* (2006.01)
*H01R 25/16* (2006.01)
*H01R 4/28* (2006.01)

(52) U.S. Cl.
CPC ..... *H01R 13/2407* (2013.01); *H01R 4/28* (2013.01); *H01R 25/16* (2013.01)

(58) Field of Classification Search
CPC ..... H01R 13/2407; H01R 4/28; H01R 25/16; H01R 12/721; H01R 12/737
See application file for complete search history.

(56) References Cited

U.S. PATENT DOCUMENTS 6,652,322 B2 * 11/2003 Ito ..... H01R 12/721 439/857
9,033,750 B2 * 5/2015 Miller ..... H01R 13/26 439/862
9,537,242 B2 * 1/2017 Chen ..... H01R 13/18
10,826,215 B2 * 11/2020 Zhang ..... H01R 13/04

FOREIGN PATENT DOCUMENTS

CN 106654666 A * 5/2017

* cited by examiner

*Primary Examiner* — Oscar C Jimenez
*Assistant Examiner* — Paul D Baillargeon
(74) *Attorney, Agent, or Firm* — Barley Snyder

(57) ABSTRACT

A connector comprises a pair of terminals for clamping and electrically connecting to a first conductive member. A first terminal includes a plurality of first elastic arms arranged in a row, with each first elastic arm having a first contact and a third contact formed thereon. The second terminal is laminated on an outer side of the first terminal and includes a plurality of second elastic arms arranged in a row. Each second elastic arm includes a second contact formed thereon. Each second contact protrudes to an inner side of the first elastic arms from a gap between two adjacent first elastic arms. The plurality of second elastic arms respectively abut against the outer sides of the plurality of first elastic arms. The first contact, the second contact and the third contact are adapted to be in electrical contact with the inserted first conductive member simultaneously.

20 Claims, 8 Drawing Sheets

ELECTRICAL CONNECTOR

CROSS-REFERENCE TO RELATED APPLICATIONS

This application claims the priority benefit of Chinese Patent Application No. 202011156609.X filed on Oct. 26, 2020, the whole disclosure of which is incorporated herein by reference.

FIELD OF THE INVENTION

The present disclosure relates to a connector, and more particularly to a connector for electrically connecting an electrode of a power source to a bus bar.

BACKGROUND

According to the prior art, a connector used to electrically connect an electrode of a power source to a bus bar typically includes a conductor block on which a slot is formed. The electrode of the power source is adapted to be inserted into the slot for electrically connecting to the conductor block. However, the current carrying capacity of this type of connector is insufficient, and the ability to reliably contact the electrode of the power source during an installation process is insufficient, and cannot meet the requirements of customers.

Accordingly, improved connectors for mating a power source to a bus bar are desired.

SUMMARY

According to an embodiment of the present disclosure a connector comprises a pair of terminals for clamping and electrically connecting to a first conductive member. A first terminal includes a plurality of first elastic arms arranged in a row, with each first elastic arm having a first contact and a third contact formed thereon. The second terminal is laminated on an outer side of the first terminal and includes a plurality of second elastic arms arranged in a row. Each second elastic arm includes a second contact formed thereon. Each second contact protrudes to an inner side of the first elastic arms from a gap between two adjacent first elastic arms. The plurality of second elastic arms respectively abut against the outer sides of the plurality of first elastic arms. The first contact, the second contact and the third contact are adapted to be in electrical contact with the inserted first conductive member simultaneously.

BRIEF DESCRIPTION OF THE DRAWINGS

The invention will now be described by way of example with reference to the accompanying Figures, of which.

DETAILED DESCRIPTION OF THE EMBODIMENTS

Figure 1:
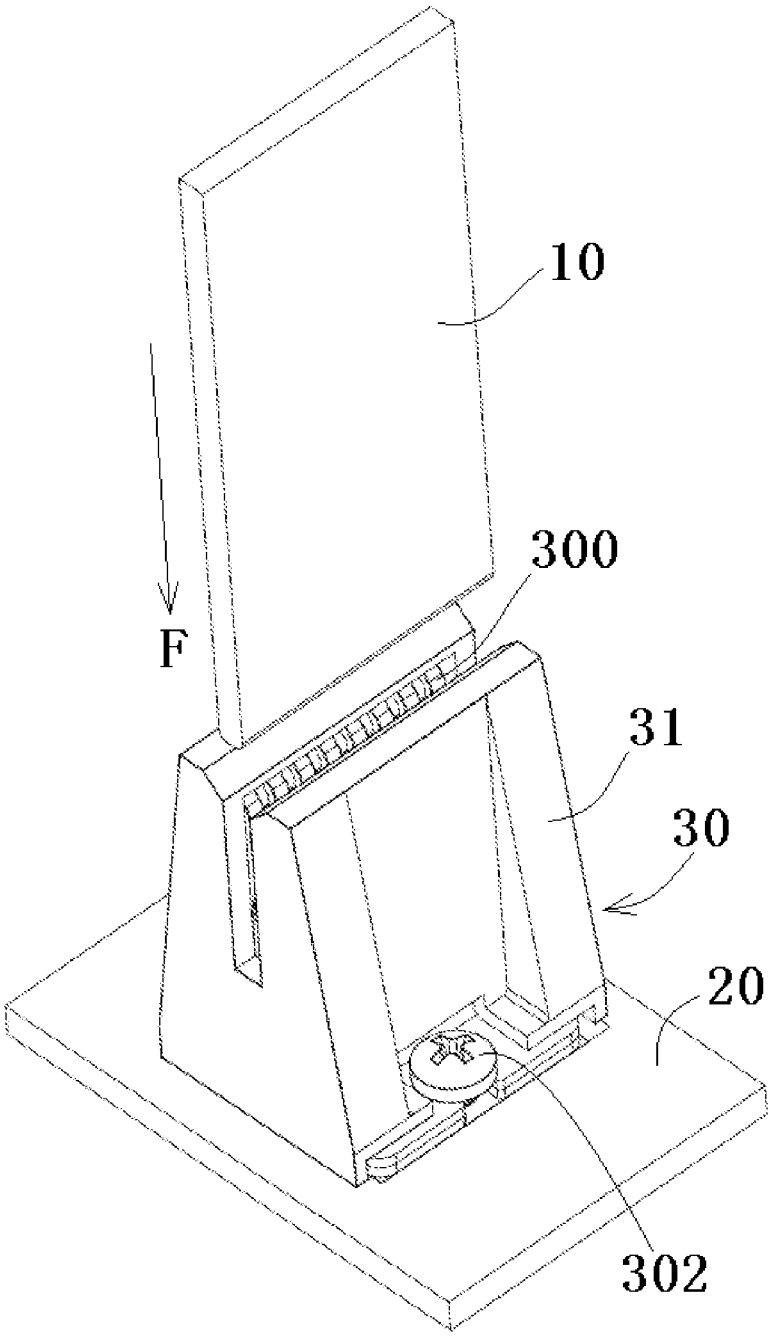
FIG. 1 shows a perspective diagram of a connector according to an exemplary embodiment of the present disclosure.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Embodiments of the present disclosure include a connector comprising a pair of laminated terminals adapted to clamp and electrically connect to a first conductive member. Each laminated terminal includes a first terminal and a second terminal laminated on an outer side of the first terminal. The first terminal comprises a plurality of first elastic arms arranged in a row, and the second terminal comprises a plurality of second elastic arms arranged in a row, and the plurality of second elastic arms respectively abut against the outer sides of the plurality of first elastic arms. A first contact and a third contact are formed on each first elastic arm, and a second contact is formed on each second elastic arm. Each second contact is adapted to protrude to an inner side of the first elastic arm from a gap between two adjacent first elastic arms. The first contact, the second contact and the third contact are adapted to be in electrical contact with the inserted first conductive member simultaneously.

According to another embodiment of the present disclosure a connector includes a pair of laminated terminals which are adapted to clamp and electrically connect to a first conductive member. Each laminated terminal comprises a first terminal and a second terminal laminated on an outer side of the first terminal. The first terminal comprises a plurality of first elastic arms arranged in a row, and the second terminal comprises a plurality of second elastic arms arranged in a row. The plurality of second elastic arms and the plurality of first elastic arms are arranged in a staggered manner. A first contact and a third contact are formed on each first elastic arm, and a second contact is formed on each second elastic arm. The first contact, the second contact and the third contact are adapted to make an electrical contact with the inserted first conductive member simultaneously.

Figure 2:
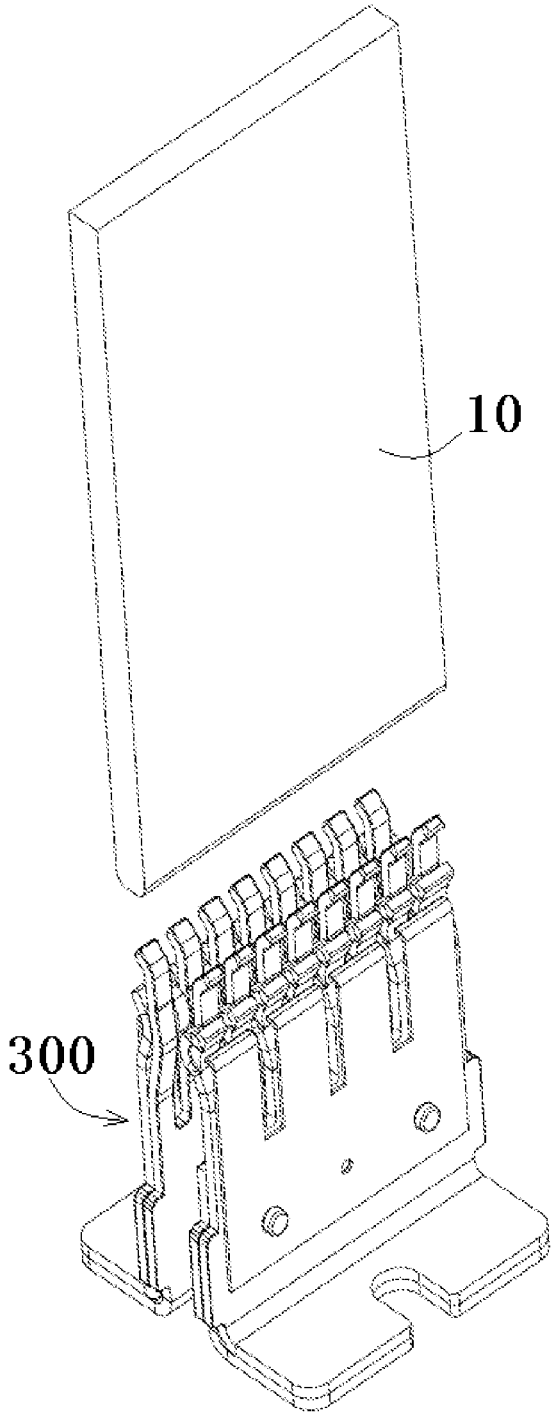
FIG. 2 shows a perspective diagram of a pair of laminated terminals and a first conductive member of the connector shown in FIG. 1.

FIG. 1 shows a perspective diagram of a connector according to an exemplary embodiment of the present disclosure, and FIG. 2 shows a perspective diagram of a pair of laminated terminals and a first conductive member of the connector shown in FIG. 1. As shown, the exemplary connector 30 primarily includes a housing 31 and a pair of laminated terminals 300. The pair of laminated terminals 300 are installed in the housing 31. The pair of laminate terminals 300 is adapted to clamp a first conductive member 10 inserted therebetween to make an electrical contact with the first conductive member 10.

Figure 3:
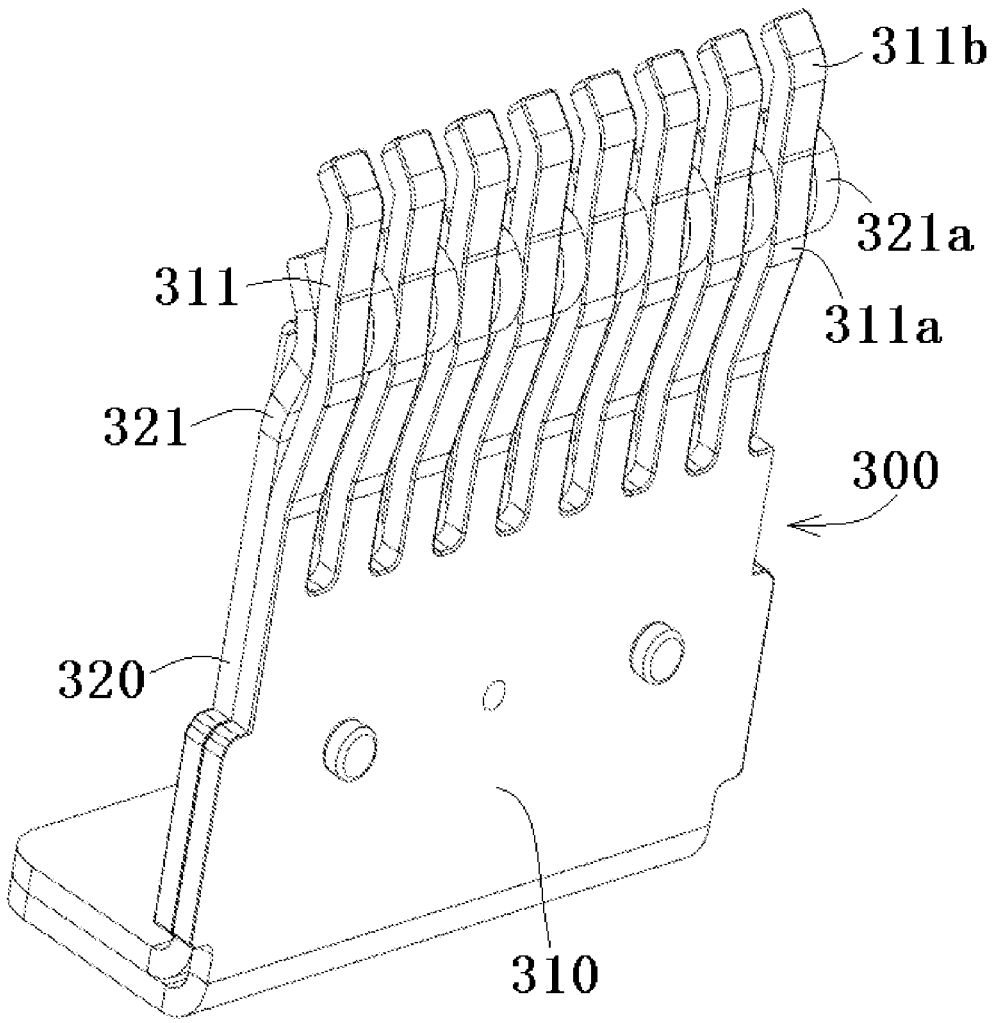
FIG. 3 shows a perspective diagram of the laminated terminal shown in FIG. 2 when viewed from the inside.
Figure 4:
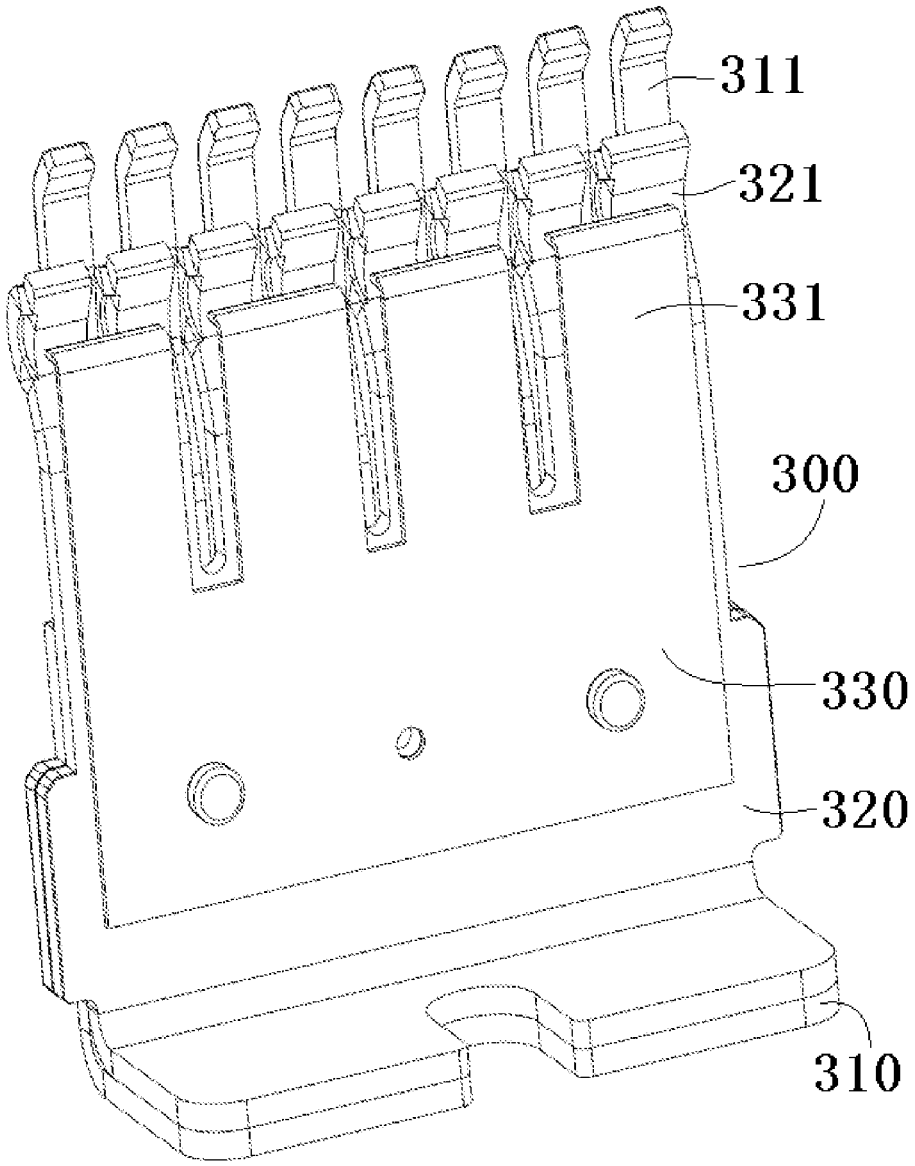
FIG. 4 shows a perspective diagram of the laminated terminal shown in FIG. 2 when viewed from the outside.

FIG. 3 shows a perspective diagram of the laminated terminal shown in FIG. 2 when viewed from the inside, and FIG. 4 shows a perspective diagram of the laminated terminal shown in FIG. 2 when viewed from the outside. Each laminate terminal 300 includes a first terminal 310 and a second terminal 320 laminated on or laid upon the outer side of the first terminal 310.

Figure 5:
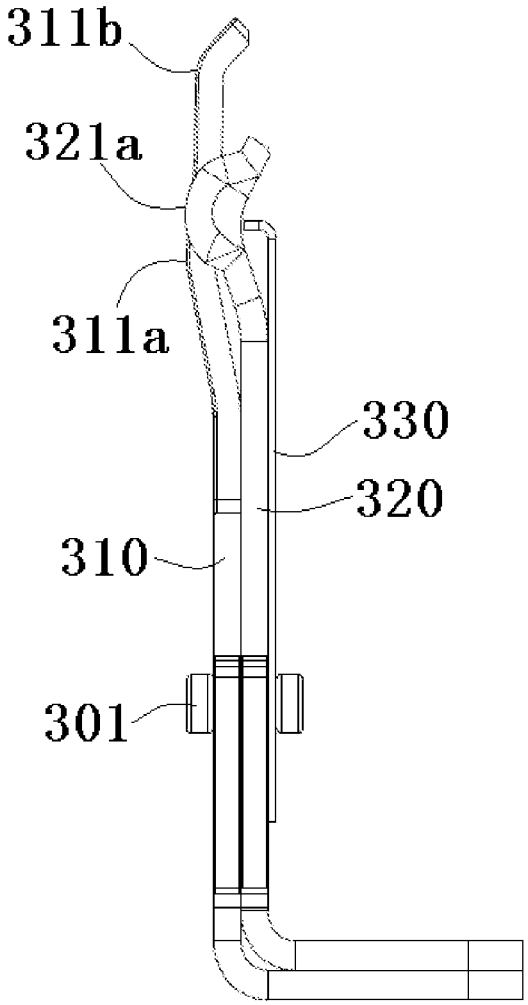
FIG. 5 shows a side view of the laminated terminal shown in FIG. 2.
Figure 6:
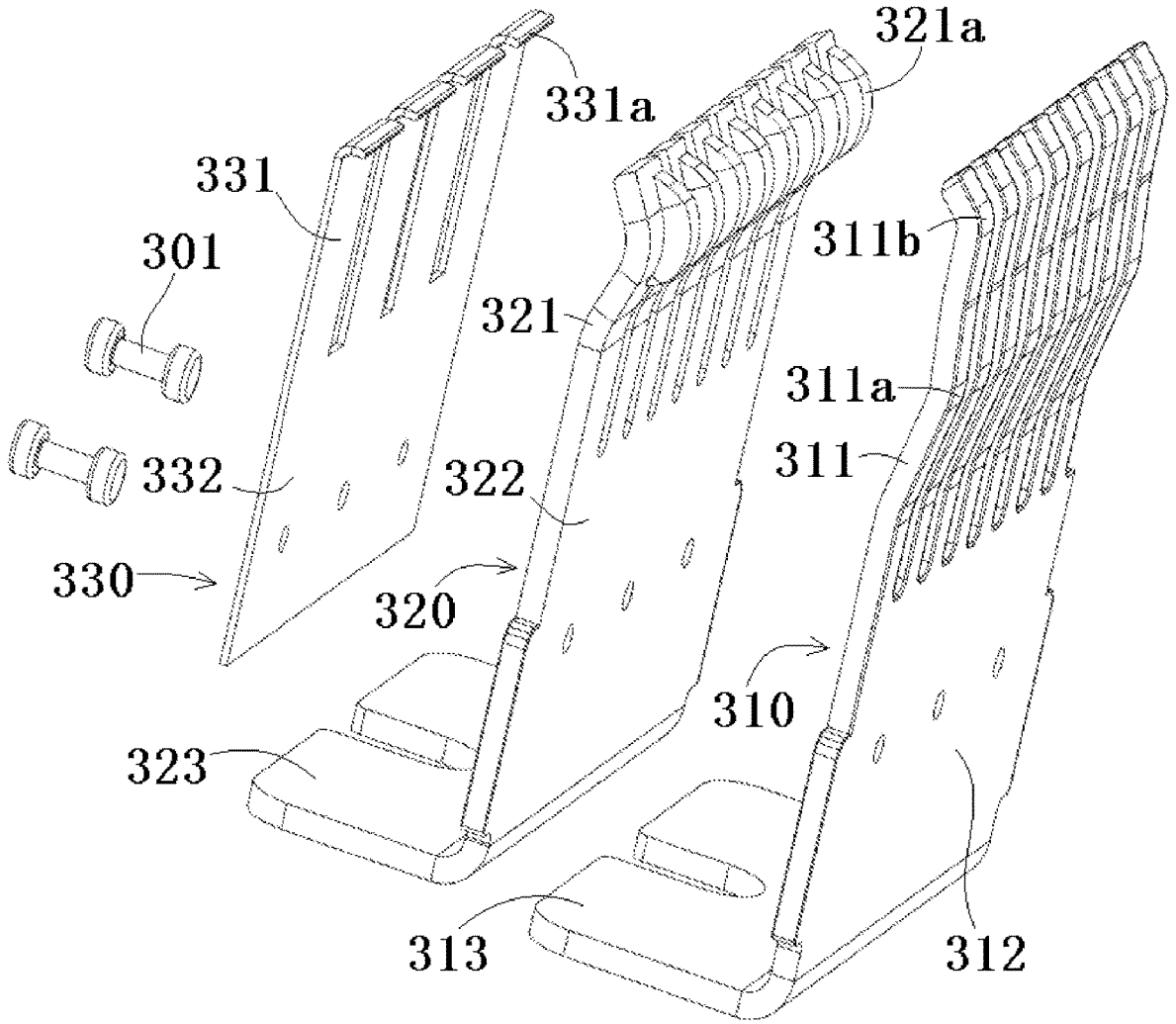
FIG. 6 shows an exploded perspective diagram of the laminated terminal shown in FIG. 2.

FIG. 5 shows a side view of the laminated terminal shown in FIG. 2, and FIG. 6 shows an exploded perspective diagram of the laminated terminal shown in FIG. 2. The first terminal 310 includes a plurality of first elastic arms 311 arranged in a row, and the second terminal 320 includes a plurality of second elastic arms 321 arranged in a row. As shown in FIGS. 3 and 4, the plurality of second elastic arms 321 respectively abut against the outer sides of the plurality of first elastic arms 311.

As shown in FIGS. 3 to 6, in the exemplary embodiment, a raised first contact 311*a* is formed on the first elastic arm 311, and a raised second contact 321*a* is formed on the second elastic arm 321. The second contact 321*a* is adapted to protrude from the gap between two adjacent first elastic arms 311 to the inner side of the first elastic arm 311. Specifically, the second contact 321*a* is adapted to pass through the gap between two adjacent first elastic arms 311, so that the first contact 311*a* and the second contact 321*a* are adapted to make an electrical contact with the inserted first conductive member 10 at the same time.

Referring again to FIGS. 1 and 2, the first elastic arm 311 of the first terminal 310 and the second elastic arm 321 of the second terminal 320 are received in the slot of the housing 31 to make an electrical contact with the first conductive member 10 inserted into the slot of the housing 31.

Figure 7:
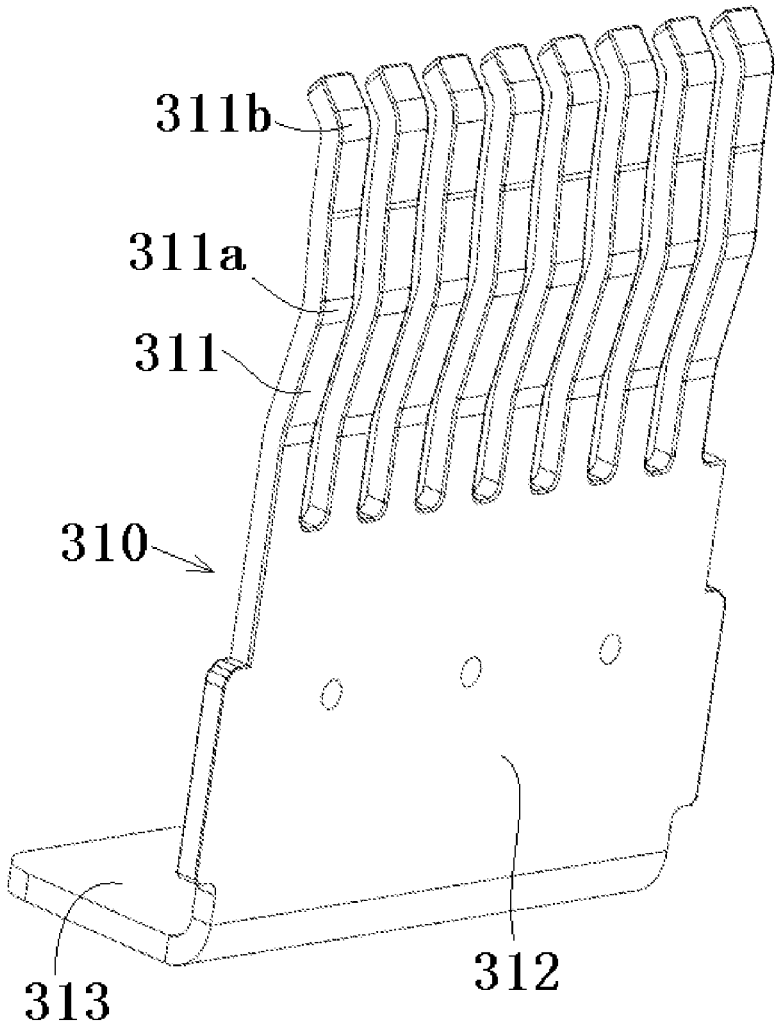
FIG. 7 shows a perspective diagram of the first terminal in the laminated terminal shown in FIG. 6.
Figure 8:
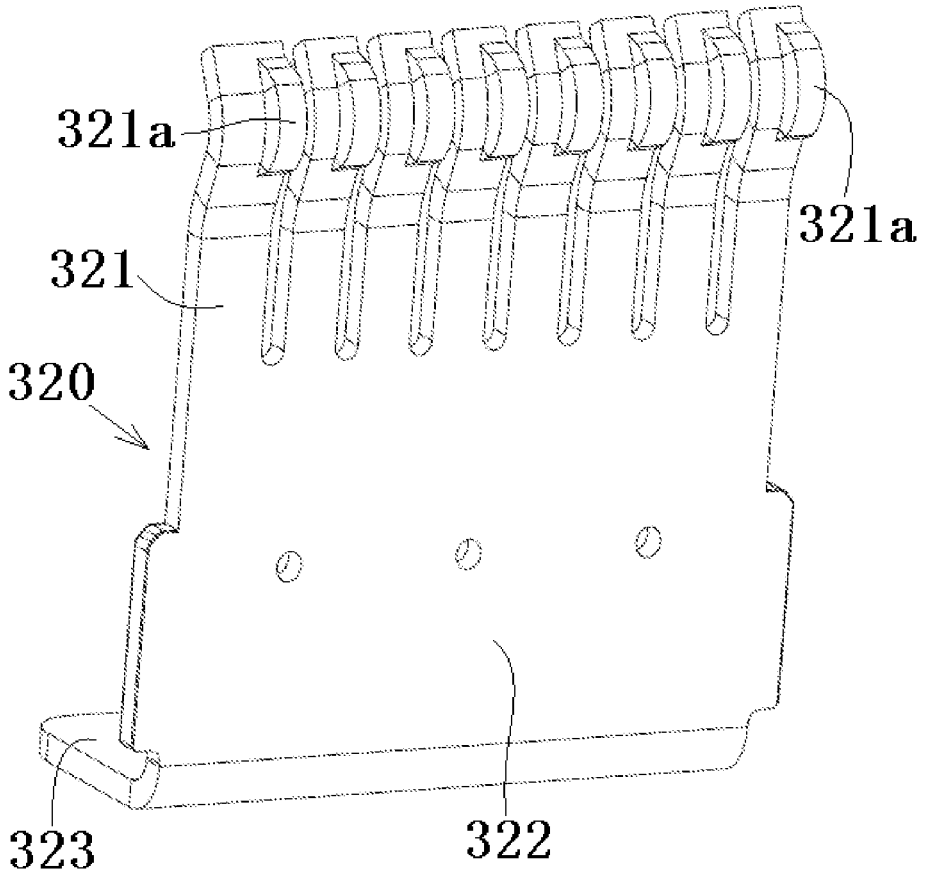
FIG. 8 shows a perspective diagram of the second terminal in the laminated terminal shown in FIG. 6.

FIG. 7 shows a perspective diagram of the first terminal in the laminated terminal shown in FIG. 6, and FIG. 8 shows a perspective diagram of the second terminal in the laminated terminal shown in FIG. 6. The width of the second elastic arm 321 is greater than the width of the first elastic arm 311 and smaller than the sum of the width of the first elastic arm 311 and the width of the gap between two adjacent first elastic arms 311. In this way, it can be ensured that the second elastic arm 321 and the first elastic arm 311 are in contact with each other.

As shown in FIGS. 3 to 8, the length of the first elastic arm 311 is greater than the length of the second elastic arm 321, and the end portion of the first elastic arm 311 extends beyond the end portion of the second elastic arm 321. A raised third contact 311*b* is also formed on the first elastic arm 311, and the third contact 311*b* is formed on the end portion of the first elastic arm 311. The first contact 311*a*, the second contact 321*a* and the third contact 311*b* are adapted to be electrical contact with the inserted first conductive member 10 at the same time. Therefore, the contact area between the terminals 300 and the first conductive member 10 is increased, the current carrying capacity of the connector is improved, and the elastic contact force and electrical contact reliability of the terminals can be increased.

The second contact 321*a* is formed on the end portion of the second elastic arm 321. As shown the first elastic arm 311 is bent into a wavy shape (i.e., a shape with alternating concavity along its length) with two crests, and the first contact 311*a* and the third contact 311*b* constitute the two crests of the first elastic arm 311. The third contact 311*b* and the first contact 311*a* are separated by a predetermined distance in the insertion direction F of the first conductive member 10; in the insertion direction F of the first conductive member 10, the second contact 321*a* is located between the first contact 311*a* and the third contact 311*b*.

As shown in FIGS. 1 to 8, during the process of inserting the first conductive member 10 between the pair of laminated terminals 300, the first conductive member 10 firstly makes an electrical contact with the third contact 311*b*, secondly makes an electrical contact with the second contact 321*a*, and finally makes an electrical contact with the first contact 311*a*. During the process of pulling out the first conductive member 10 from between the pair of laminated terminals 300, the first conductive member 10 is firstly separated from the first contact 311*a*, is secondly separated from the second contact 321*a*, and is finally separated from the third contact 311*b*.

Each laminated terminal 300 further includes an auxiliary terminal 330, which is laminated on the outside of the second terminal 320. The auxiliary terminal 330 has an auxiliary elastic arm 331. The auxiliary elastic arm 331 abuts against the second elastic arm 321. The first terminal 310, the second terminal 320 and the auxiliary terminal 330 are fixed together to form a laminated terminal 300.

The first terminal 310 further includes a first plate-shaped base 312, and the first elastic arm 311 is connected to the first plate-shaped base 312 and extends forward; the second terminal 320 further includes a second plate-shaped base 322, and the second elastic arm 321 is connected to the second plate-shaped base 322 and extends forward; the auxiliary terminal 330 also includes a third plate-shaped base 332, and the auxiliary elastic arm 331 is connected to the third plate-shaped base 332 and extends forward.

The second plate-shaped base 322 is laminated on the first plate-shaped base 312, and the third plate-shaped base 332 is laminated on the second plate-shaped base 322. The first plate-shaped base 312, the second plate-shaped base 322, and the third plate-shaped base 332 are fixed together to fix the first terminal 310, the second terminal 320, and the auxiliary terminal 330 together. The first plate-shaped base 312, the second plate-shaped base 322 and the third plate-shaped base 332 are riveted together by a plurality of rivets 301. However, the present disclosure is not limited to this. The first plate-shaped base 312, the second plate-shaped base 322, and the third plate-shaped base 332 can also be fixed together in other ways, for example, in a way of a bolt connection or a way of a snap-fit.

The first terminal 310 further includes a first plate-shaped fixing portion 313, and the second terminal 320 further includes a second plate-shaped fixing portion 323 which is laminated on the first plate-shaped fixing portion 313. The first plate-shaped fixing portion 313 and the second plate-shaped fixing portion 323 are adapted to be fixed and electrically connected to a second conductive member 20 by screws 302, thereby electrically connecting the connector to the second conductive member 20.

The first plate-shaped fixing portion 313 is connected to the side of the first plate-shaped base portion 312 opposite to the first elastic arm 311, and is bent with respect to the first plate-shaped base 312 at a predetermined angle, for example, of around 90 degrees. The second plate-shaped fixing portion 323 is connected to the side of the second plate-shaped base 322 opposite to the second elastic arm 321 and is bent with respect to the second plate-shaped base 322 at a predetermined angle, for example, of around 90 degrees.

In the exemplary embodiment, the first conductive member 10 is the electrode of the power source, the second conductive member 20 is the bus bar, and the connector is adapted to electrically connect the electrode of the power source to the power connector of the bus bar.

The first terminal 310 and the second terminal 320 may be made of a first metal material, and the auxiliary terminal 330 is made of a second metal material. In one embodiment, the electrical conductivity of the first metal material is greater than that of the second metal material, and the mechanical strength (e.g., yield strength) of the second metal material is greater than that of the first metal material. More specifically, the first terminal 310 and the second terminal 320 are made of copper or copper alloy, and the auxiliary terminal 330 is made of stainless steel.

Although not shown, in another exemplary embodiment of the present disclosure, a connector is also disclosed which includes a pair of laminated terminals, and the pair of laminated terminals are adapted to clamp and be electrically connected to a first conductive member. Each laminated terminal includes a first terminal and a second terminal laminated on the outer side of the first terminal. The first terminal includes a plurality of first elastic arms arranged in a row, the second terminal includes a plurality of second elastic arms arranged in a row, and the plurality of second elastic arms and the plurality of first elastic arms are arranged in a staggered manner, that is, one second elastic arm is arranged in the gap between two adjacent first elastic arms, or one first elastic arm is arranged in the gap between two adjacent second elastic arms. A first contact and a third contact are formed on the first elastic arm, and a second contact is formed on the second elastic arm. The first contact, the second contact and the third contact are adapted to make an electrical contact with the inserted first conductive member simultaneously.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector, comprising:

a pair of terminals for clamping and electrically connecting to a first conductive member, each terminal including:

a first terminal having a plurality of first elastic arms arranged in a row, each first elastic arm having a first contact and a third contact formed thereon; and a second terminal laminated on an outer side of the first terminal and having a plurality of second elastic arms arranged in a row, each second elastic arm having a second contact formed thereon, each second contact adapted to protrude to an inner side of the first elastic arms from a gap between two adjacent first elastic arms, the plurality of second elastic arms respectively abut against the outer sides of the plurality of first elastic arms, the first contact, the second contact and the third contact adapted to be in electrical contact with the inserted first conductive member simultaneously.

2. The connector according to claim 1, wherein a width of the second elastic arm is greater than a width of the first elastic arm and is smaller than a sum of the width of the first elastic arm and a width of a gap between two adjacent first elastic arms.

3. The connector according to claim 1, wherein a length of the first elastic arm is greater than a length of the second elastic arm, and an end portion of the first elastic arm extends beyond an end portion of the second elastic arm.

4. The connector according to claim 3, wherein the third contact is formed on the end portion of the first elastic arm, and the second contact is formed on the end portion of the second elastic arm.

5. The connector according to claim 3, wherein the first elastic arm is bent into a shape of alternating concavity defining two crests, each crest defining a respective one of the first contact and the third contact.

6. The connector according to claim 3, wherein:

the third contact and the first contact are separated by a predetermined distance in an insertion direction of the first conductive member; and in the insertion direction of the first conductive member, the second contact is located between the first contact and the third contact.

7. The connector according to claim 6, wherein in a process of inserting the first conductive member between the pair of terminals, the first conductive member firstly makes an electrical contact with the third contact, secondly makes an electrical contact with the second contact, and finally makes an electrical contact with the first contact.

8. The connector according to claim 6, wherein in a process of pulling out the first conductive member from between the pair of laminated terminals, the first conductive member is firstly separated from the first contact, is secondly separated from the second contact, and is finally separated from the third contact.

9. The connector according to claim 1, wherein each terminal further includes an auxiliary terminal laminated on an outer side of the second terminal, each auxiliary terminal having an auxiliary elastic arm abutting against the second elastic arm.

10. The connector according to claim 9, wherein the first terminal, the second terminal and the auxiliary terminal are fixed together to form a laminated terminal.

11. The connector according to claim 9, wherein:

the first terminal further includes a first plate-shaped base, the first elastic arm connected to the first plate-shaped base and extending therefrom in a first direction;

the second terminal further includes a second plate-shaped base, the second elastic arm connected to the second plate-shaped base and extending therefrom in the first direction; and the auxiliary terminal further includes a third plate-shaped base, the auxiliary elastic arm connected to the third plate-shaped base and extending therefrom in the first direction.

12. The connector according to claim 11, wherein the second plate-shaped base is laminated on the first plate-shaped base, and the third plate-shaped base is laminated on the second plate-shaped base, the first plate-shaped base, the second plate-shaped base, and the third plate-shaped base are fixed together so as to fix the first terminal, the second terminal and the auxiliary terminal together.

13. The connector according to claim 12, wherein the first plate-shaped base, the second plate-shaped base and the third plate-shaped base are riveted together.

14. The connector according to claim 11, wherein:

the first terminal further includes a first plate-shaped fixing portion, the second terminal further includes a second plate-shaped fixing portion, and the second plate-shaped fixing portion is laminated on the first plate-shaped fixing portion, and the first plate-shaped fixing portion and the second plate-shaped fixing portion are adapted to be fixed and electrically connected to a second conductive member via a fastener for electrically connecting the connector to the second conductive member.

15. The connector according to claim 14, wherein:

the first plate-shaped fixing portion is connected to a side of the first plate-shaped base opposite to the first elastic arm, and is bent with respect to the first plate-shaped base at a predetermined angle; and the second plate-shaped fixing portion is connected to a side of the second plate-shaped base opposite to the second elastic arm, and is bent with respect to the second plate-shaped base at a predetermined angle.

16. The connector according to claim 14, wherein the first conductive member is an electrode of a power source, the second conductive member is a bus bar, and the connector is a power connector adapted to electrically connect the electrode of the power source to the bus bar.

17. The connector according to claim 9, wherein the first terminal and the second terminal are made of a first metal material, and the auxiliary terminal is made of a second metal material, the electrical conductivity of the first metal material is greater than that of the second metal material, and the mechanical strength of the second metal material is greater than that of the first metal material.

18. The connector according to claim 17, wherein the first terminal and the second terminal are made of copper or copper alloy, and the auxiliary terminal is made of stainless steel.

19. The connector according to claim 1, further comprising a housing, the pair of laminated terminals are installed in the housing, and the first elastic arm and the second elastic arm are received in a slot of the housing for electrically contacting the first conductive member inserted into the slot.

20. A terminal for an electrical connector, comprising:

a first terminal including a plurality of first elastic arms arranged in a row, each first elastic arm having a first contact and a third contact formed thereon;

a second terminal laminated on an outer side of the first terminal and including a plurality of second elastic arms arranged in a row, each second elastic arm having a second contact formed thereon, the plurality of second elastic arms and the plurality of first elastic arms arranged in a staggered manner, and the first contact, the second contact and the third contact are adapted to make an electrical contact with the inserted first conductive member simultaneously; and an auxiliary terminal laminated on an outer side of the second terminal, each auxiliary terminal having an auxiliary elastic arm abutting against the second elastic arm.

* * * * *